US009730571B1

(12) United States Patent
Lee et al.

(10) Patent No.: US 9,730,571 B1
(45) Date of Patent: Aug. 15, 2017

(54) FOLDABLE DISH RACK

(71) Applicant: Robinson Home Products Inc., Williamsville, NY (US)

(72) Inventors: Stuart Harvey Lee, Forest Hills, NY (US); Jochen Schaepers, New York, NY (US); Juan Ernesto Jimenez, Brooklyn, NY (US)

(73) Assignee: Robinson Home Products Inc., Williamsville, NY (US)

( * ) Notice: Subject to any disclaimer, the term of this patent is extended or adjusted under 35 U.S.C. 154(b) by 0 days.

(21) Appl. No.: 15/041,945

(22) Filed: Feb. 11, 2016

(51) Int. Cl.
*A47L 19/04* (2006.01)

(52) U.S. Cl.
CPC ..... *A47L 19/04* (2013.01)

(58) Field of Classification Search
CPC ..... A47L 15/50; A47L 15/502; A47L 15/503; A47L 15/505; A47L 19/00; A47L 19/02; A47L 19/04
USPC ..... 211/41.1, 41.2, 41.3, 41.4, 41.5, 41.6, 211/41.7, 41.8, 41.9; 206/45.23, 736, 774
See application file for complete search history.

(56) References Cited

U.S. PATENT DOCUMENTS 846,263 A * 3/1907 Tibbits ..... A47L 19/04 211/41.4
990,454 A * 4/1911 Peters ..... A47L 19/04 211/41.5
3,025,967 A * 3/1962 Christophersen ..... A47L 19/00 211/41.5
4,448,292 A * 5/1984 Comfort ..... A45C 5/00 190/107
6,170,676 B1 * 1/2001 Patadia ..... A47L 19/04 211/41.3
6,357,605 B1 * 3/2002 Martorella ..... A47L 19/04 211/41.5
D716,547 S * 11/2014 Pennington ..... D3/262
8,960,452 B2 * 2/2015 Rhodes, II ..... A47L 19/04 211/41.6
D732,256 S * 6/2015 Huang ..... D32/55
2001/0040141 A1 * 11/2001 Martorella ..... A47L 19/04 211/41.6
2005/0145583 A1 * 7/2005 Martorella ..... A47L 19/04 211/41.6
2005/0209014 A1 * 9/2005 Kim ..... A63B 24/0021 473/157
2008/0149644 A1 * 6/2008 Piacenza ..... A47L 19/04 220/572

(Continued)

FOREIGN PATENT DOCUMENTS

FR 730779 A * 8/1932 ..... A47L 19/04
GB 2042147 A * 9/1980 ..... A47L 19/04

*Primary Examiner* — Joshua Rodden
(74) *Attorney, Agent, or Firm* — Florek & Endres PLLC

(57) ABSTRACT

A foldable dish rack having a case including a base, a lid, and a side wall extending from the periphery of at least a portion of the base, and a mat including a plurality of projections and a first mat hinge dividing a first mat portion and a second mat portion that provides for the second mat portion to fold relative the first mat portion from a planar configuration to a folded configuration whereby the second mat portion rests flat on the first mat portion, with the lid connected to a portion of the side wall by a case hinge such that the lid is capable of converting from a closed configuration against the side walls to an open configuration approximately perpendicular to a plane of the base.

25 Claims, 4 Drawing Sheets

(56) References Cited

U.S. PATENT DOCUMENTS

2008/0283480 A1* 11/2008 Segall ..... A47L 19/02
211/41.6
2009/0272658 A1* 11/2009 Elias ..... A45C 5/03
206/45.23

* cited by examiner

FOLDABLE DISH RACK

FIELD OF THE INVENTION

The present invention relates to kitchen accessories, and more particular to a foldable dish rack for drying dishes, cookware, glasses, cutlery, and the like after washing.

BACKGROUND OF THE INVENTION

After hand-washing dishes, it is common to place the dishes on a countertop rack to allow for air drying or for holding wet dishes prior to hand drying all of the dishes at once. After the dishes have dried and have been put away, the dish rack is often stored, for example in a cabinet, until it is needed again.

Dish racks generally take a significant amount of countertop space because a larger area to hold more dishes on a dishrack is desirable. As a consequence, dish racks are often bulky and are difficult to store.

One attempt to create a less bulky drying solution has been the dish drying mat, which is generally a flexible substrate upon which wet dishes can be stacked. The drying mat can then be folded or rolled for storage when it is not in use. However, the traditional drying mat does not have any side walls to allow for plates or other items to be leaned in a vertical orientation to thereby maximize the number of dishes that can be held on the drying mat.

Accordingly, there is a need in the art for a dish drying rack that provides for a large area for drying dishes that can be reduced to a relatively compact size and shape for storage. There is also a need in the art for a dish drying rack that allows larger items to be held vertically by leaning against a side wall that can be reduced to a relatively compact size and shape for storage.

SUMMARY OF THE INVENTION

The present invention is directed to a dish rack having a case member including a base, a side wall extending from the base, and a lid connected to a portion of the side wall by a case hinge such that the lid is capable of converting from a closed configuration against the side wall to an open configuration approximately perpendicular to the plane of the base, and a mat adapted to engage the base that includes a plurality of projections, a first mat hinge dividing a first mat portion and a second mat portion that provides for the second mat portion to fold relative the first mat portion from a planar configuration to a folded configuration whereby the second mat portion rests flat on the first mat portion.

It is preferred that the base include at least one arm having first and second ends, with the first end connected to the side wall, or the base, and the second end connected to the lid. The arm can be a strip of material that is flexible, such as a strip of silicon or other solid or woven material, or can be a more rigid material with an arm hinge such that the arm is capable of deployment from a collapsed configuration to a raised configuration. In this regard, the arm can be permanently attached at the first and second ends or can be removably attached at one or more of the first and second ends. In any embodiment, the one or more arms hold the lid in the open configuration to prevent the lid from collapsing under the weight of dishes that may be leaned up against it.

It is also preferred that the mat include a second mat hinge dividing the second mat portion and a third mat portion that provides for the third mat portion to fold relative the second mat portion from a planar configuration to a folded configuration whereby the third mat portion rests flat on the second mat portion.

The mat hinge(s) allows the mat to be folded into the case for storage and unfolded for use as a dish drying rack. In particular, the dish rack is used by lifting the lid from the closed configuration to the open configuration and securing it in place by raising the one or two arms that extend from the side wall of the case and attach to the lid. The mat may then be unfolded into a planar configuration and dishes can be placed on the mat for drying while being supported by the projections of the mat as well as the lid.

After use, the mat can be folded back into the case, the one or two arms being collapsed into the case on top of the folded mat, and the lid is closed. The use of a second mat hinge provides that the mat can be folded into approximately thirds, thereby reducing the overall size of the folded mat, as well as the case.

In a preferred embodiment, the mat engages the case through the use of cooperating elements that help retain the mat in place relative to the case. The cooperating elements can comprise a grove and a rib, where a groove on the mat is engaged by a rib on the case, a tab on the mat or on the case that is received by an aperture on the other of the mat and the case, etc., which cooperate to resist movement of the mat relative to the case.

"Dishes" as used herein may refer to plates, bowls, saucers, cups, glasses, mugs, cutlery, cookware, food preparation tools and appliances, and similar items that are desired to be air-dried on a countertop.

BRIEF DESCRIPTION OF THE DRAWINGS

The attached drawings are intended to better illustrate a preferred embodiment of the present invention without limiting the invention in any manner whatsoever.

DETAILED DESCRIPTION OF THE PREFERRED EMBODIMENTS

The following description of preferred embodiments is presented to describe the present invention and is not to be construed to limit the scope of the claims in any manner whatsoever.

Figure 1:
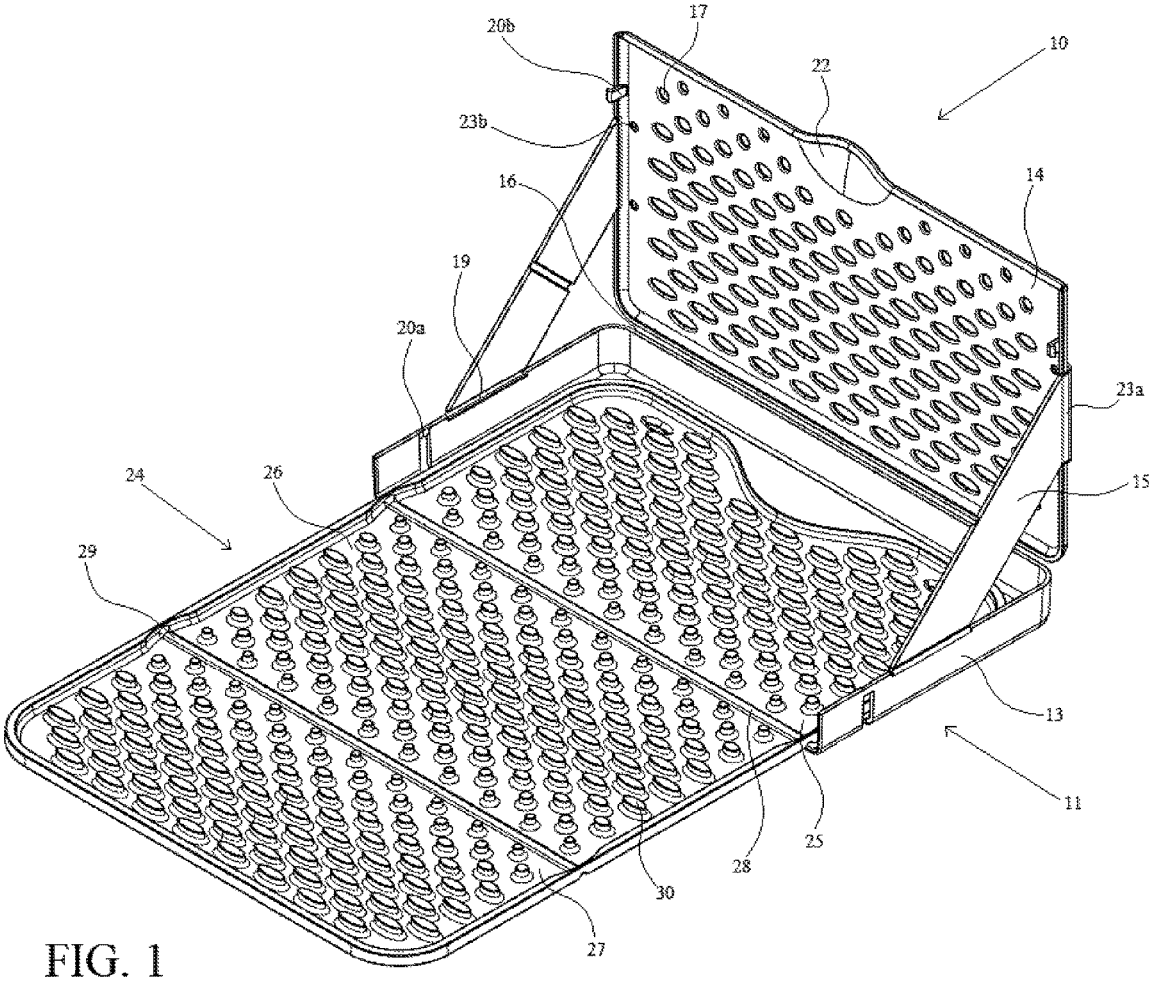
FIG. 1 is a perspective view of the preferred embodiment of the dish rack of the present invention in the open configuration.
Figure 2:
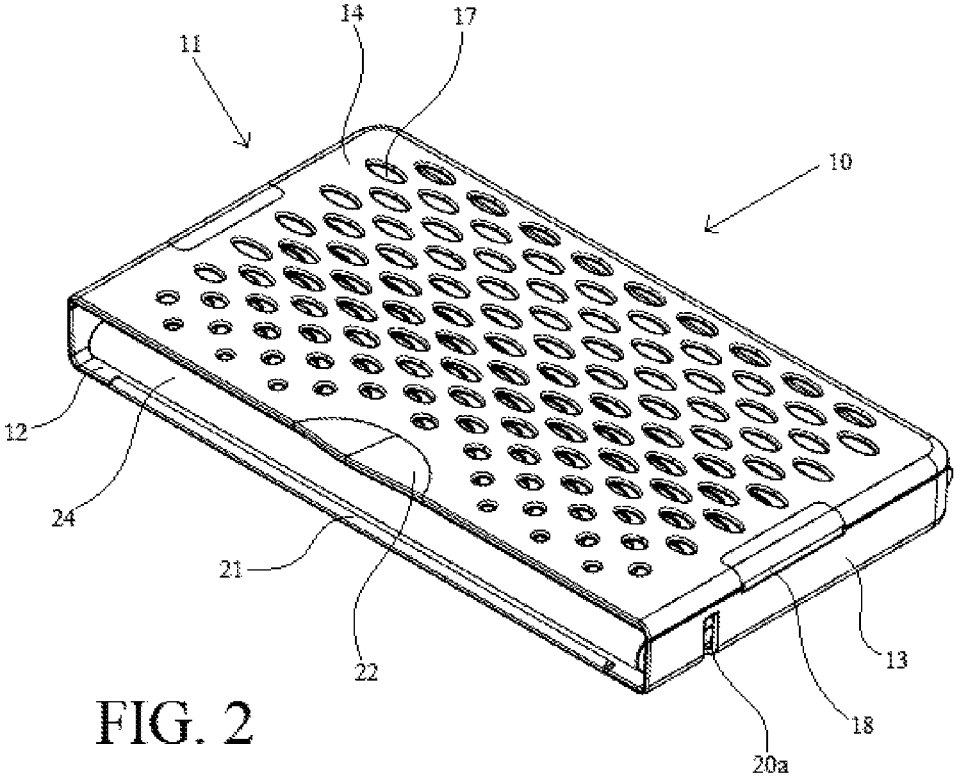
FIG. 2 is a perspective view of the preferred embodiment of the dish rack of the present invention in the closed configuration.
Figure 3:
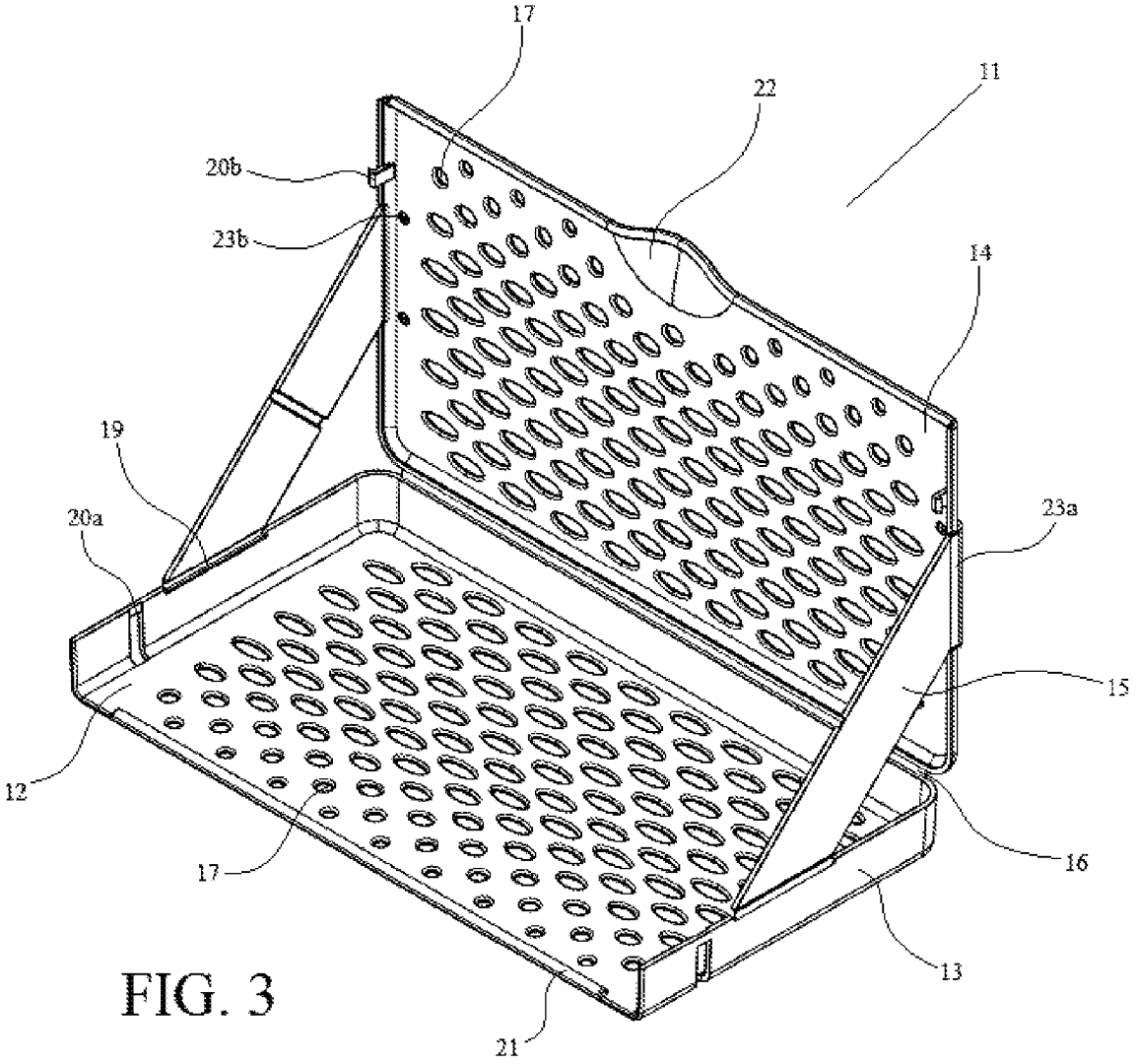
FIG. 3 is a perspective view of the preferred embodiment of the case of the dish rack of the present invention in the open configuration.
Figure 4:
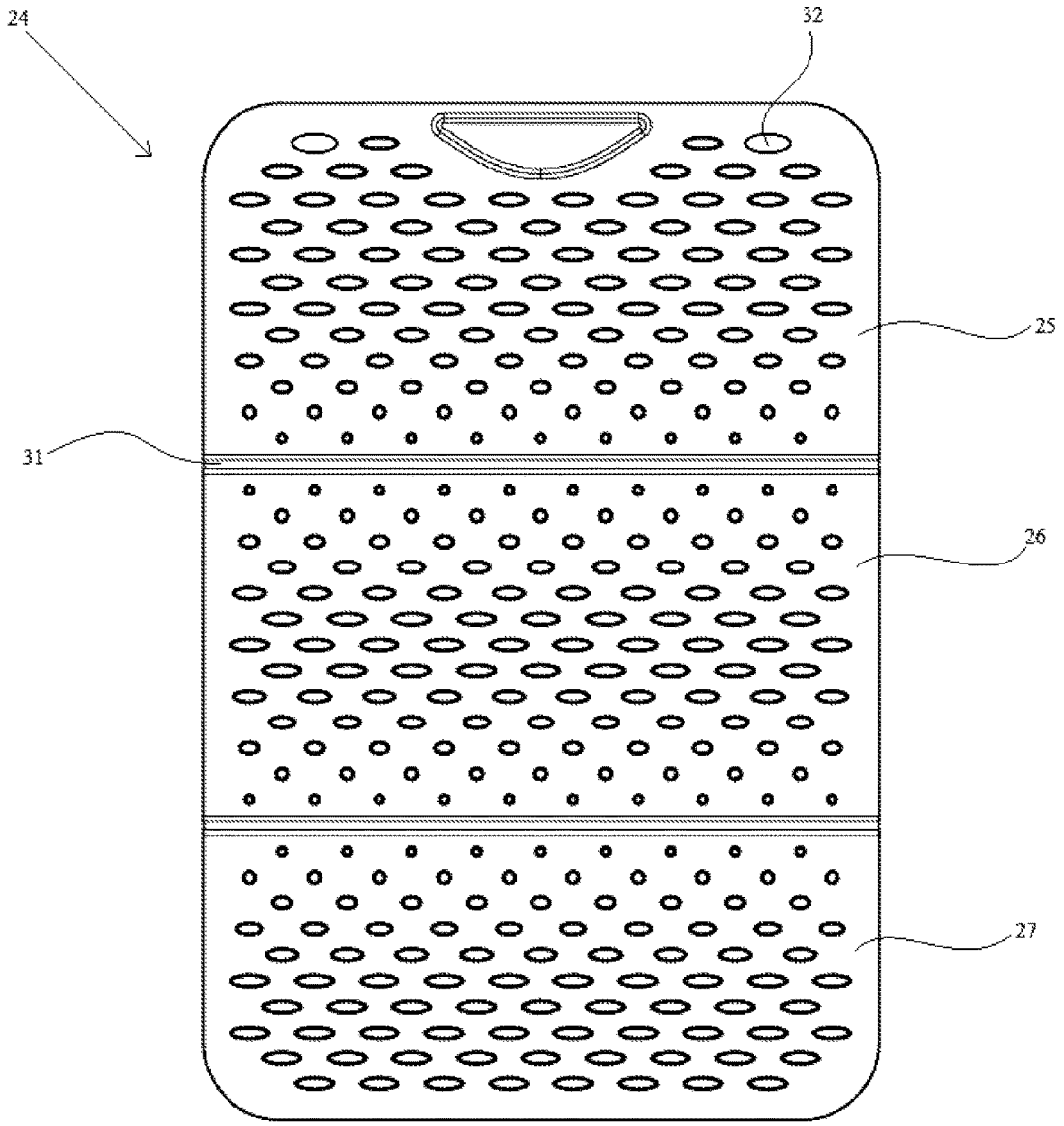
FIG. 4 is a bottom plan view of the preferred embodiment of the mat of the dish rack of the present invention in its unfolded or planar configuration.

The preferred embodiment of the present invention, shown in FIGS. 1-4, is directed to a dish rack 10 having a case 11 including a base 12, a side wall 13 extending approximately perpendicular from the base 12 at its periphery, and a lid 14 connected to a portion of the side wall 13 by a case hinge 16, such that the lid 14 is capable of a closed configuration resting against the side wall 13 and an open configuration approximately perpendicular to a plane of the base 12. Stated differently, the lid 14 is preferably capable of a range of motion from about 0° in the closed configuration to about 90° in the open configuration, and in some embodiments may have a full range of motion from about 0-180°.

In the preferred embodiment, the dish rack 10 also employs a mat 24 that includes a plurality of projections 30, a first mat hinge 28 dividing a first mat portion 25 and a second mat portion 26 that provides for the second mat portion 26 to fold relative the first mat portion 25 from a planar configuration to a folded configuration whereby the second mat portion 26 rests flat on the first mat portion 25. The preferred embodiment further comprises a second mat hinge 29 dividing the second mat portion 26 and a third mat portion 27, such that the third mat portion 27 folds relative the second mat portion 26 from a planar configuration to a folded configuration whereby the third mat portion 27 rests flat on the second mat portion 26.

The first mat portion 25, second mat portion 26, and third mat portion 27 are sequential, with the second mat portion 26 lying between the first mat portion 25 and third mat portion 27. In an embodiment of the present invention, the first mat portion 25, second mat portion 26, and third mat portion 27 have substantially equal lengths (the length of the mat refers to the dimension on the axis perpendicular to the mat hinges). However, in a more preferred embodiment, the first mat portion 25, second mat portion 26, and third mat portion 27 do not have the exact same length to thereby enable better folding for storage in the case 11, Preferably, the first mat portion 25 has a length equal to or greater than the second mat portion 26, which has a length greater than the third mat portion 27. Most preferably, the second mat portion 26 may have a length that is 80-99% of the length of the first mat portion 25, more preferably 90-99%, and the third mat portion 27 may have a length that is 80-99% of the length of the second mat portion 26, more preferably 80-90%.

The case 11 of the present invention is preferably made from a rigid plastic, with polypropylene being most preferred. The mat 24 of the present invention is preferably made from a flexible or resilient material, such as a thermoplastic elastomer, and most preferably a silicone based thermoplastic elastomer. The case hinge 16, first mat hinge 28 and second mat hinge 29 may be any type of hinge known to those skilled in the art such as a living hinge, continuous hinge or hook hinge, and are preferably a living hinge.

In the preferred embodiment shown, the case 11 also includes two arms 15 having first and second ends, with the first end connected to the side wall 13 by an arm hinge 19 such that the arm 15 is capable of converting between a collapsed configuration and a raised configuration in which the second end removably attaches to the lid 14 when it is in the open configuration. In an alternative embodiment, the second end of the arm is connected to the lid 14 by an arm hinge 19 and the first end of the arm 15 removably attaches to the side wall 13 in the open configuration. The arm hinges 19 may be any type of hinge known to those skilled in the art such as a living hinge, continuous hinge or hook hinge, and is preferably attached by a hook hinge or living hinge. In the raised configuration, the arms 15 should form an angle between the side wall 13 and lid 14 of about 30-60°, preferably about 45°.

Although the arms 15 can be permanently attached at both ends, the preferred arms 15 are removably attached to the side wall 13 or lid 14, and most preferably are removably attached to the lid 14 by a pair of cooperating members 23*a*, 23*b*, with the first of the cooperating members 23*a* located on the second end of the arms 15 and the second of the cooperating members 23*b* located on the inner surface of the side wall 13 or lid 14. The cooperating members 23*a*, 23*b* may be any suitable type, including catches, hooks, snaps, clasps, pins, latches, clips, or the like. In a preferred embodiment, the cooperating members 23*a*, 23*b* are catches on the second end of the arms 15 that engage holes on the lid 14.

In an embodiment, the arms 15 may employ an additional hinge located between the first and second ends, preferably approximately at the lengthwise middle of the arm 15, allowing the arm 15 to be folded about its middle for easier storage in the case 11. This permits the non-removable attachment of the arms 15 at both the side wall 13 and the lid 14. Alternatively, a strip of flexible material, such as silicone, can be attached between the base 11 or side wall 13 and lid 14, either permanently or by a removable attachment at one or both ends.

In an embodiment of the present invention, the mat 24 removably engages the case 11. In a preferred embodiment, the mat 24 may engage the base 12 by a cooperating groove 31 and rib 21. Preferably, the groove 31 is located on the underside of the mat 24, and most preferably at the first mat hinge 28 on the underside of the mat 24, and the rib 21 is located on the inner surface of the base 12. In a preferred embodiment, the groove 31 and the first mat hinge 28 are one in the same, with the groove 31 being formed as the underside of the first mat hinge 28.

In an alternative embodiment, the mat 24 may be attached to the base 12 by one or more tabs 32, such as straight or mushroom shaped tabs, on one of the upper surface of the base 12 or the underside of the mat 24 that engage corresponding apertures 17 on the other of the upper surface of the base 12 or the underside of the mat 24. The tabs 32 are preferably made of the same material as the mat 24 or the base 12, depending on their location, and are press-fit into apertures 17 of corresponding size and shape.

Preferably, there will be two tabs 32 for the mat 24 to engage the case 11, related to each side of the mat 24 near the end of the mat 24 against the side wall 13. It is also contemplated that the mat 24 may removably engage the side wall 13 by any of the methods described above and merely rest on the top surface of the base 12.

It is preferred that the mat 24 engages the case 11 such that the first portion 25 of the mat 24 lie within the case 11, with the groove 31 coinciding with the rib 21. In this embodiment, the second mat portion 26 is positioned outside the case 11 in the planar configuration and inside of the case 11 in the folded configuration, and the third mat portion 27 is positioned outside the case 11 in the planar configuration and inside of the case 11 in the folded configuration, when the second mat portion 26 is also in the folded configuration. By "inside" the case it is meant that a majority of the portion is located within the bounds of the base 12, preferably with substantially the entirety of each of the mat portions located within the bounds of the base 12 and within the dimensions of the case 11.

The mat 24 preferably includes a plurality of projections 30 that provide support for holding dishes as well as providing channels for water drainage and improved aeration. The projections 30 may be any suitable shape such as rectangular, circular, elliptical, sinusoidal, triangular, diamond, polygonal and combinations thereof, and are preferably elliptical, circular or a combination thereof. In an embodiment of the present invention, the projections 30 are circular adjacent the first mat hinge 28 and second mat hinge 29 and are elliptical at the approximate center of the first mat portion 25, second mat portion 26, and third mat portion 27. The projections 30 preferably have a height of approximately 1-10 mm, more preferably approximately 5-10 mm, and most preferably approximately 6 mm.

The projections 30 may be present on the first mat portion 25, second mat portion 26, third mat portion 27, or any combination thereof. In an embodiment of the present invention, the pattern of the projections 30 are different on at least one of the first mat portion 25, second mat portion 26, and third mat portion 27.

In addition, the mat 24 may also include a structural component about the periphery of the mat 24 to maintain the shape of the mat 24 when in use and during folding. The structural component can merely be areas of thickened silicone, metal wire or other material that provides additional structural support.

In a preferred embodiment, the case 11 is rectangular having four sides and the side wall 13 partially surrounds the base 12 on at least a portion of three sides. Preferably, the case hinge 16 connects the lid 14 and the side wall 13 along one side of the case 11, and the side wall 13 is absent on the side of the case 11 opposite the case hinge 16. In a preferred embodiment, the rib 21 is located at the edge of the base 12 on the side of the case 11 where the side wall 13 is absent.

The case 11 may also include a plurality of apertures 17 on the base 12, lid 14 or both to allow airflow and thereby speed the drying of dishes as well as to promote drying and prevent mold and mildew when the mat 24 is stored in the case 11. The apertures 17 may be any suitable shape such as rectangular, circular, elliptical, sinusoidal, triangular, diamond, polygonal and combinations thereof, and are preferably elliptical, circular or a combination thereof. In an embodiment of the present invention, the apertures 17 are circular at the edges of the case 11 opposite the case hinge 16 and elliptical adjacent the case hinge 16.

In a preferred embodiment of the present invention, the case 11 includes a recess 18 on the sides of the lid 14 adjacent the case hinge 16 and opposite each of the arm hinges 19 that receives the arm hinge 19 when the lid 14 is in the closed configuration. The length of the recess 18 may be equal to or greater than the length of the arm hinge 19 thereby allowing the lid 14 to close completely against the side wall 13, i.e., to close over the arm hinges 19 located on the side wall 13. In an alternative embodiment wherein the arms 15 are connected to the lid 14 by an arm hinge 19, the recesses 18 are located on the side wall 13 on its sides adjacent the case hinge 16.

The preferred dish rack 10 also includes an engagement feature 22 extending from the lid 14 of the case 11 to assist in moving the lid 14 between the closed and open configurations. The engagement feature 22 is preferably located on the side of the lid 14 opposite the case hinge 16. In a preferred embodiment, the case 11 also employs cooperating members 20*a*, 20*b* for locking the lid 14 to the side wall 13 or base 12 of the case 11 when the lid 14 is in the closed configuration. Preferably, the first cooperating member 20*a* is located on the side wall 13 at the sides adjacent the case hinge 16 and the second cooperating member 20*b* is located on the inner surface of the lid 14 at the sides adjacent the case hinge 16. The cooperating members 20*a*, 20*b* may be any suitable type, including catches, latches, hooks, snaps, clasps, clips, pins, or the like.

Variations, modifications and alterations to the above detailed description will be apparent to those skilled in the art. All such variations, modifications and/or alternatives are intended to fall within the scope of the present invention, limited only by the appended claims.

The invention claimed is:

1. A dish rack comprising:

a case comprising a base, a lid, and a side wall extending from at least a portion of a periphery of the base;

a mat comprising a plurality of projections and a first mat hinge dividing a first mat portion and a second mat portion, the first mat hinge providing that the second mat portion can fold relative the first mat portion, from a planar configuration to a folded configuration, whereby the second mat portion rests flat on the first mat portion;

wherein the lid is connected to a portion of the side wall by a case hinge such that the lid is capable of converting from a closed configuration against the side wall to an open configuration approximately perpendicular to a plane of the base; and further wherein the first mat portion comprises a cooperating member to engage the case; and wherein at least one of the lid and base comprise a plurality of apertures.

2. The dish rack of claim 1 wherein the case further comprises at least one arm having first and second ends, wherein the first end of the arm is connected to a portion of the side wall and the second end of the arm is connected to the lid when the lid is in the open configuration.

3. The dish rack of claim 2 wherein at least one of the connections between the first end of the arm and the side wall and the second end of the arm and the lid is a removable connection.

4. The dish rack of claim 2 further comprising cooperating members on the second end of the at least one arm and the lid to removably connect the at least one arm to the lid in the open configuration.

5. The dish rack of claim 1 wherein the first mat portion of the mat engages the base of the case.

6. The dish rack of claim 1 wherein the second mat portion is positioned outside of the case in the planar configuration and inside of the case in the folded configuration.

7. The dish rack of claim 1 wherein the mat further comprises a second mat hinge dividing the second mat portion and a third mat portion that provides for the third mat portion to fold relative the second mat portion from a planar configuration to a folded configuration whereby the third mat portion rests flat on the second portion when in the folded configuration.

8. The dish rack of claim 7 wherein the third mat portion is positioned outside of the case in the planar configuration and is positioned inside of the case in the folded configuration when the second mat portion is also in the folded configuration.

9. The dish rack of claim 1 wherein the case is rectangular, having four sides, and the side wall surrounds the base on at least a portion of three sides.

10. The dish rack of claim 9 wherein the case hinge is between the lid and the side wall along one side of the case.

11. The dish rack of claim 10 wherein the side wall is not present on the side of the case opposite the case hinge.

12. The dish rack of claim 10 wherein one or two arm hinges are on the sides of the case adjacent the case hinge.

13. The dish rack of claim 12 wherein the lid further comprises a recess on the sides adjacent the case hinge that receives the arm hinges when the lid is in the closed configuration.

14. A dish rack comprising:

a case comprising a base, a lid, and a side wall extending from at least a portion of a periphery of the base;

a mat comprising a plurality of projections and a first mat hinge dividing a first mat portion and a second mat portion, the first mat hinge providing that the second mat portion can fold relative the first mat portion, from a planar configuration to a folded configuration, whereby the second mat portion rests flat on the first mat portion;

wherein the lid is connected to a portion of the side wall by a case hinge such that the lid is capable of converting from a closed configuration against the side wall to an open configuration approximately perpendicular to a plane of the base; and further wherein the first mat portion comprises a cooperating member to engage the case; and a rib on the base that cooperates with a groove on an underside of the mat for the mat to engage the base.

15. The dish rack of claim 14 wherein the case further comprises at least one arm having first and second ends, wherein the first end of the arm is connected to a portion of the side wall and the second end of the arm is connected to the lid when the lid is in the open configuration.

16. The dish rack of claim 15 further comprising cooperating members on the second end of the at least one arm and the lid to removably connect the at least one arm to the lid in the open configuration.

17. The dish rack of claim 14 wherein the case is rectangular, having four sides, and the side wall surrounds the base on at least a portion of three sides.

18. The dish rack of claim 17 wherein the case hinge is between the lid and the side wall along one side of the case.

19. The dish rack of claim 18 wherein one or two arm hinges are on the sides of the case adjacent the case hinge.

20. The dish rack of claim 19 wherein the lid further comprises a recess on the sides adjacent the case hinge that receives the arm hinges when the lid is in the closed configuration.

21. A dish rack comprising:

a case comprising (a) a base, (b) a side wall extending from a periphery of at least a portion of the base; (c) a lid comprising a plurality of apertures, wherein the lid is connected to a portion of the side wall by a case hinge such that the lid is capable of converting from a closed configuration against the side wall to an open configuration approximately perpendicular to a plane of the base, and (d) two arms having first and second ends, wherein the first ends are connected to a portion of the side wall and the second ends contact the lid when the lid is in the open configuration;

a mat comprising (a) a plurality of projections, (b) a first mat hinge dividing a first mat portion and a second mat portion that provides for the second mat portion to fold relative the first mat portion from a planar configuration to a folded configuration whereby the second mat portion rests flat on the first mat portion, and (c) a second mat hinge dividing the second mat portion and a third mat portion that provides for the third mat portion to fold relative the second mat portion from a planar configuration to a folded configuration whereby the third mat portion rests flat on the first mat portion;

wherein the first mat portion engages the base of the case.

22. The dish rack of claim 21 wherein the case is rectangular having four sides and the side wall surrounds the base on at least a portion of three sides.

23. The dish rack of claim 21 wherein the case hinge is between the lid and the side wall along one side of the case.

24. The dish rack of claim 22 wherein the side wall is not present on the side of the case opposite the case hinge.

25. The dish rack of claim 22 wherein the arms further comprise arm hinges on the side wall of the case adjacent the case hinge.

* * * * *